US008573557B2

(12) United States Patent
Carbaugh et al.

(10) Patent No.: US 8,573,557 B2
(45) Date of Patent: Nov. 5, 2013

(54) BIDIRECTIONAL RAM BOP AND METHOD

(75) Inventors: William L. Carbaugh, Humble, TX (US); Eric Mei, Houston, TX (US); Leonard G. Childers, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 666 days.

(21) Appl. No.: 12/338,051

(22) Filed: Dec. 18, 2008

(65) Prior Publication Data

US 2010/0155080 A1 Jun. 24, 2010

(51) Int. Cl.
*E21B 33/06* (2006.01)

(52) U.S. Cl.
USPC ..... 251/1.3; 251/175; 166/86.2; 166/86.3; 166/87.1

(58) Field of Classification Search
USPC ..... 251/1.3, 1.1, 172, 175; 166/86.2, 86.3, 166/87.1, 84.3
See application file for complete search history.

(56) References Cited

U.S. PATENT DOCUMENTS

| | | | | |
|---|---|---|---|---|
| 3,897,824 | A | 8/1975 | Fisher | |
| 3,906,993 | A | 9/1975 | Adams et al. | |
| 4,236,692 | A | 12/1980 | Williamson | |
| 4,444,404 | A * | 4/1984 | Parks, Jr. | 277/325 |
| 4,982,889 | A | 1/1991 | Eardley | |
| 5,255,890 | A * | 10/1993 | Morrill | 251/1.3 |
| 6,164,619 | A | 12/2000 | Van Winkle et al. | |
| 7,410,003 | B2 | 8/2008 | Ravensbergen et al. | |
| 2003/0024705 | A1 * | 2/2003 | Whitby et al. | 166/363 |
| 2008/0135791 | A1 * | 6/2008 | Juda et al. | 251/1.3 |

FOREIGN PATENT DOCUMENTS

| | | | |
|---|---|---|---|
| EP | 1985795 | A2 | 10/2008 |
| WO | WO 2006040590 | A1 * | 4/2006 |

OTHER PUBLICATIONS

Search Report and Written Opinion issued Aug. 18, 2011 in connection with corresponding EP Application No. 09178140.1.

* cited by examiner

*Primary Examiner* — John Bastianelli
*Assistant Examiner* — Ian Paquette
(74) *Attorney, Agent, or Firm* — Bracewell & Giuliani LLP

(57) ABSTRACT

A ram blowout preventer for sealing a well, the ram blowout preventer including a body having a cavity with a recess; a ram block configured to move inside the cavity; a top seat disposed in the recess and configured to seal the well when in contact with the ram block; a movable lock ring extending inside a groove of the body and a corresponding groove of the top seat and configured to move inside the groove of the body, along a direction substantially parallel to the well; a first seal extending inside a groove of the top seat and configured to contact the body and the top seat; and a second seal extending inside a groove of the ram block and configured to contact the ram block and the top seat. A width of the groove of the body is larger than a width of the lock ring by a predetermined value, which is larger than normal tolerances, and a distance from a centerline of the well to the first seal is larger than a distance from the centerline of the well to the second seal.

19 Claims, 12 Drawing Sheets

BIDIRECTIONAL RAM BOP AND METHOD

BACKGROUND

1. Technical Field

Embodiments of the subject matter disclosed herein generally relate to methods and devices and, more particularly, to mechanisms and techniques for using a ram blowout preventer (BOP) when a pressure is applied from above or below the BOP.

2. Discussion of the Background

One apparatus for sealing a well is the ram BOP. The ram BOP (herein simply BOP) is a safety mechanism that is used at a wellhead of an oil or gas well. The BOP may be used for offshore drilling and also for land-based drilling. The BOP is configured to shut the flow from the well when certain events occur. One such event may be the uncontrolled flow of gas, oil or other well fluids from an underground formation into the well. Such event is sometimes referred to as a "kick" or a "blowout" and may occur when formation pressure exceeds the pressure generated by the column of drilling fluid. This event is unforeseeable and if no measures are taken to prevent and/or control it, the well and/or the associated equipment may be damaged.

The BOP may be installed on top of the well to seal the well in case that one of the above events is threatening the integrity of the well. The BOP is conventionally implemented as a valve to prevent the release of pressure either in the annular space between the casing and the drill pipe or in the open hole (i.e., hole with no drill pipe) during drilling or completion operations. However, during various tests of the rig, a pressure from above the BOP needs to be applied and this pressure needs to be confined to a space above the BOP.

FIG. 1 shows a well 10. A wellhead 12 of the well 10 may be fixed to the seabed 14. The BOP 16 is secured to the wellhead 12. FIG. 1 shows, for clarity, the BOP 16 detached from the wellhead 12. However, the BOP 16 is attached to the wellhead 12 or other part of the well. A drill pipe 18 is shown traversing the BOP 16 and entering the well 10. The BOP 16 may have two ram blocks 20 attached to corresponding pistons 22. The pistons 22 move integrally with the ram blocks 20 along directions A and B to close the well 10.

A cut view of the BOP 16 that shows the ram blocks 20 is shown in FIG. 2. The ram blocks 20 are shown closed inside a cavity 24. The cavity 24 may be bordered, at one end, by a top seat 26 and a wear plate 28. The part of cavity 24 bordered by the top seat 26 and the wear plate 28 may contact the ram blocks 20 tighter than the remainder of the cavity 24. For this reason, the top seat 26 and the wear plate 28 are fixed to the body of the BOP 16 by screws. The ram blocks 20 may include a packer 30 (which may be an elastomer) and a top seal 31, which seals the well 10 when the ram blocks 20 are closed.

When the ram blocks 20 are closed and a large pressure exists underneath, the ram blocks 20 are pushed upwards so that the ram blocks 20 slightly move towards the top seat 26. Thus, an elastomer 31 that exists between the top seat 26 and the ram blocks 20 is squeezed, achieving the sealing of the well. However, it is noted that the same is not true for a conventional BOP when the high pressure is applied on the ram blocks 20 from above, as the elastomer does not extend between the ram blocks 20 and the wear plate 28 but only between the ram blocks 20 and the top seat 26.

FIG. 3 shows a detailed view of the top seat 26. A screw 32 is shown entering the top seat 26 from right to left up to a lock ring 34. The lock ring 34 is disposed around the top seat 26. The lock ring 34 is housed partially in a groove 36 of the body of the BOP 16 and partially in a groove 38 of the top seat 26. This arrangement prevents the top seat 26 to fall into the cavity of the BOP 16. FIG. 3 also shows that a seal 40 is disposed in another groove 42 of the top seat 26 for preventing a pressure from the well entering the cavity of the BOP 16.

The conventional ram blocks 20 are designed to seal off the well in collaboration with the top seat 26 only when a pressure is applied from below the ram block, i.e., a pressure presses upwards the ram block 20 so that packer 30 and top seal 31 become active and effectively seal off the well.

However, occasionally the operator of the well needs to conduct wellbore pressure test, i.e., apply a pressure from above the BOP. With a conventional ram BOP as illustrated in FIG. 2 it is not possible to run this test as the ram BOP will not seal the well because the ram blocks will not press the top seat 26. Thus, one possibility is to provide another device (a reverse BOP) next to the BOP such that the test mode can be performed. This approach increases the footprint of the equipment and the cost of the rig, which is undesirable.

Accordingly, it would be desirable to provide systems and methods that achieve the sealing of the well when pressure is applied both from above and from below and to avoid the above noted shortcomings.

SUMMARY

According to one exemplary embodiment, there is a blowout preventer for sealing a well. The ram blowout preventer includes a body having a cavity with a recess; a ram block configured to move inside the cavity; a top seat disposed in the recess and configured to seal the well when in contact with the ram block; a movable lock ring extending inside a groove of the body and a corresponding groove of the top seat and configured to move inside the groove of the body, along a direction substantially parallel to the well; a first seal extending inside a groove of the top seat and configured to contact the body and the top seat; and a second seal extending inside a groove of the ram block and configured to contact the ram block and the top seat. A width of the groove of the body is larger than a width of the lock ring by a predetermined value, which is larger than normal tolerances, and a distance from a centerline of the well to the first seal is larger than a distance from the centerline of the well to the second seal.

According to another exemplary embodiment, there is a method for assembling a ram blowout preventer that is configured to seal a well when a pressure is applied either from above or below of the ram blowout preventer. The method includes placing a ram block in a cavity of a body of the ram blowout preventer, the cavity having a recess; disposing a top seat in the recess such that the top seat is configured to seal the well when in contact with the ram block; inserting a lock ring inside a groove of the body and a corresponding groove of the top seat, wherein the lock ring is configured to move inside the groove of the body, along a direction substantially parallel to the well; providing a first seal inside a groove of the top seat, wherein the top seat is configured to contact the body and the top seat; and providing a second seal inside a groove of the ram block, wherein the second seal is configured to contact the ram block and the top seat, where a width of the groove of the body is larger than a width of the lock ring by a predetermined value, which is larger than normal tolerances, and a distance from a centerline of the well to the first seal is larger than a distance from the centerline of the well to the second seal.

According to yet another exemplary embodiment, there is a method for sealing a well with a ram blowout preventer that is configured to seal the well when a pressure is applied either from above or below of the ram blowout preventer. The method includes applying a closing pressure to a ram block within a cavity of a body of the ram blowout preventer, wherein the cavity has a recess; moving the ram block to overlay with a top seat disposed in the recess; sliding the top seat toward the ram block when a pressure from above the ram blowout preventer acts on the top seat, wherein the top seat is configured to slide along a direction substantially parallel to the well as a lock ring, extending inside a groove of the body and a corresponding groove of the top seat, is configured to move inside the groove of the body, along the direction substantially parallel to the well; sealing a space between the body and the top seat with a first seal extending inside a groove of the top seat; and sealing a space between the ram block and the top seat with a second seal extending inside a groove of the ram block, wherein a width of the groove of the body is larger than a width of the lock ring by a predetermined value, which is larger than normal tolerances, and a distance from a centerline of the well to the first seal is larger than a distance from the centerline of the well to the second seal.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a ram BOP. However, the embodiments to be discussed next are not limited to these systems, but may be applied to other systems, i.e., a gate valve.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, a ram BOP is configured to have a movable top seat and seals that expose to pressure a larger upper surface of the top seal than a lower surface. Such a BOP that is configured to close the well when a pressure is applied either from above or from below the BOP is a bidirectional BOP. By having the movable top seat, when a pressure is applied from above, the movable top seat is displaced towards the ram blocks such that a seal between the ram blocks and the movable top seat is squeezed. It is noted that the conventional device shown in FIG. 2 achieves the seal between the top seat 26 and the ram block 20 because a pressure is exerted on the ram block 20 from below, such that the ram block 20 presses against the top seat 26 when the ram block 20 is closed. However, the device of FIG. 2 cannot seal the well when the pressure is applied on the ram block 20 from above, i.e., the ram block 20 is pressed away from the top seat 26, because an intimate contact between the ram block 20 and the top seat 26 is not made and thus, a seal between the ram block 20 and the top seat 26 is not squeezed.

Figure 1:
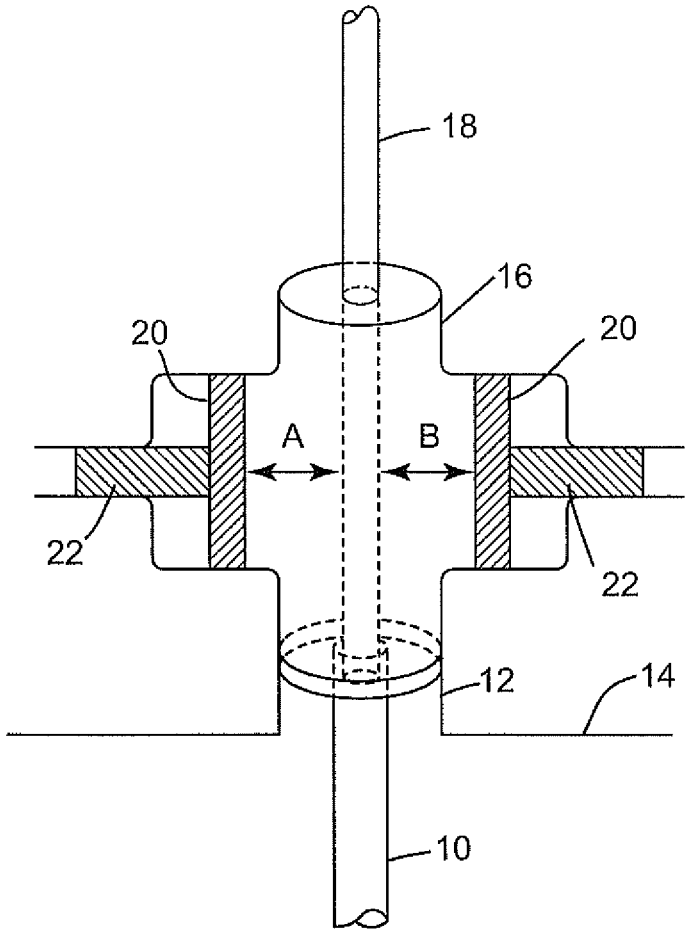
FIG. 1 Prior Art
FIG. 1 is a schematic diagram illustrating the BOP displaced on top of the well.
Figure 2:
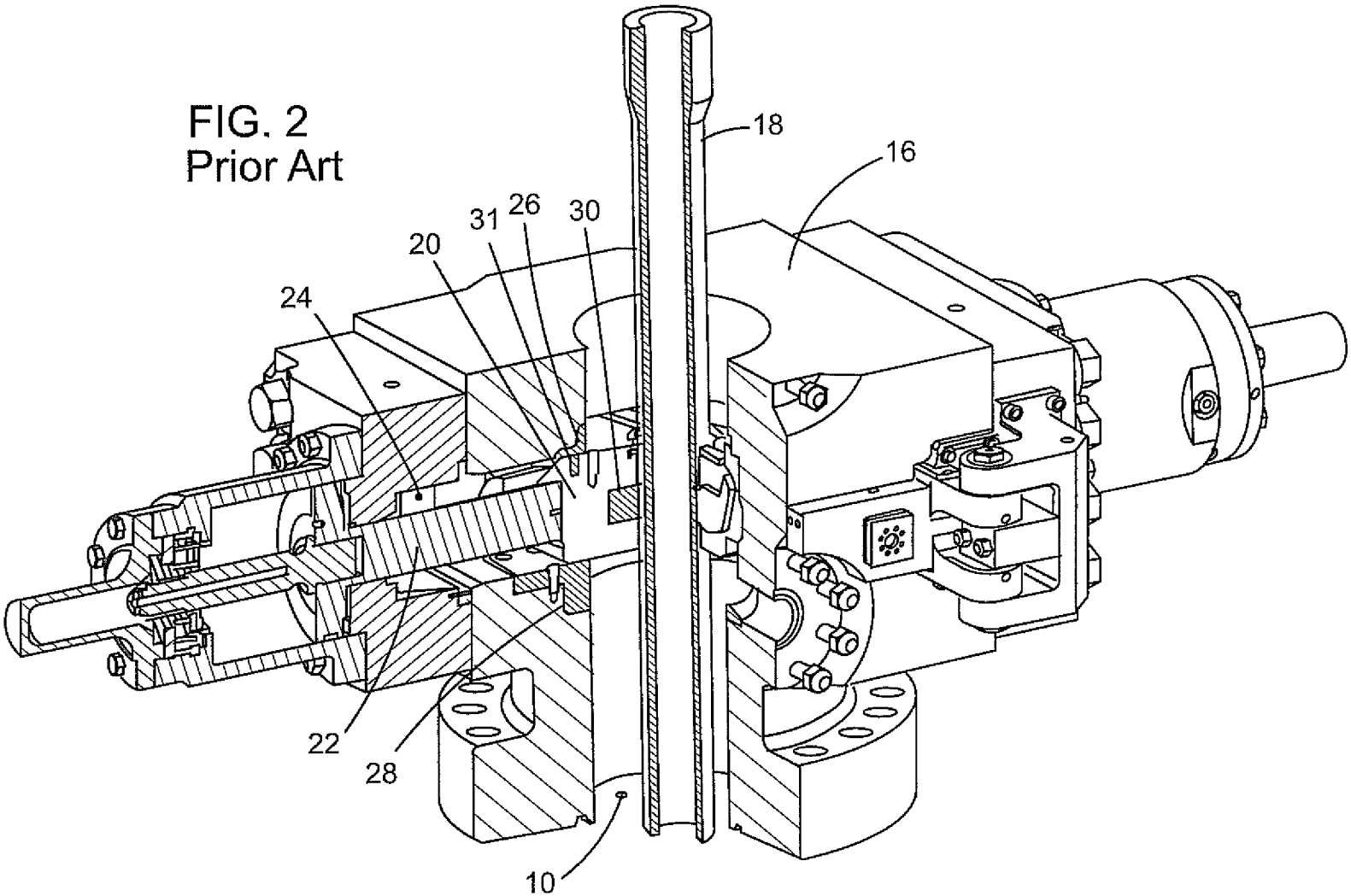
FIG. 2 Prior Art
FIG. 2 is a schematic diagram of a conventional BOP.
Figure 3:
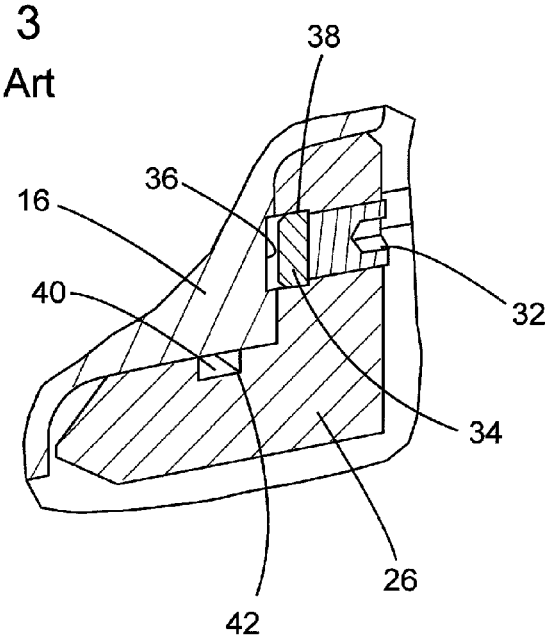
FIG. 3 Background Art
FIG. 3 is a detailed view of a top seat of the conventional BOP.
Figure 4:
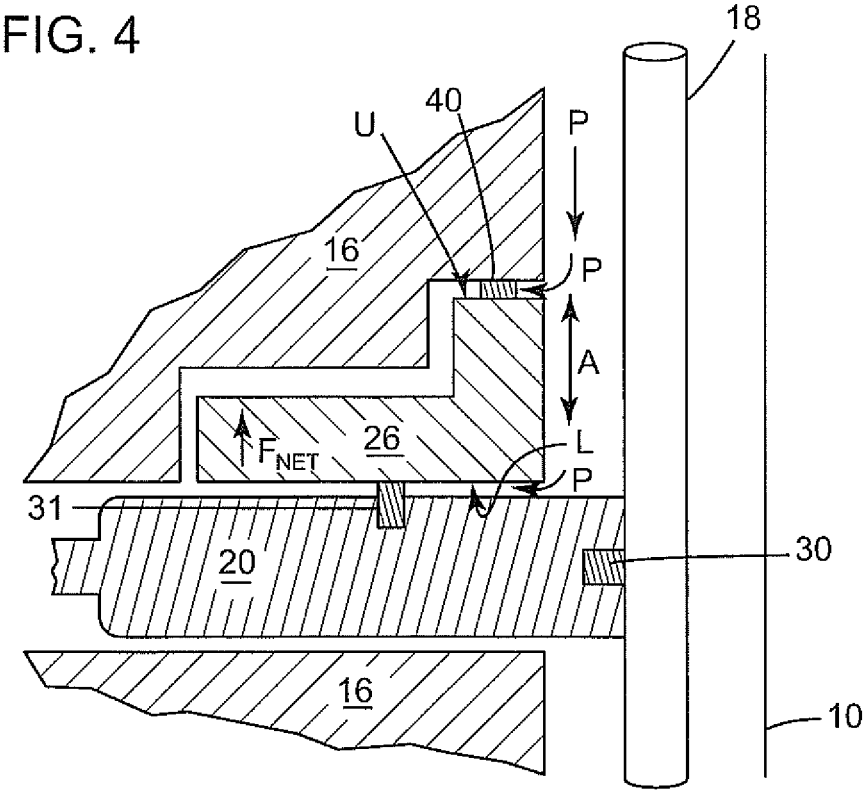
FIG. 4 is a detailed view of the seals provided for the top seat and the ram blocks of the BOP.

Even if the top seat 26 of the BOP 16 shown in FIG. 2 is allowed to move on a vertical direction A, as shown for example in FIG. 4, a pressure P applied from above the ram block 20 will not achieve the desired seal between the ram block 20 and the top seat 26. This is because the pressure P will act not only on an upper face U of the top seat 26 but also on a lower face L of the top seat 26. As the force acting on a surface is given by the product of the pressure and the area on which the pressure acts, the force exerted on the upper face U is smaller than the force exerted on the lower face L (due to the pressure P), thus resulting in a net force F in an upward direction. The distances among the various components of the BOP 16 are not shown to scale in FIG. 4. In fact, these distances are shown exaggeratedly increased for an easier understanding of the pressures involved.

However, to achieve the desired sealing between the top seat 26 and the ram block 20 when the BOP is run in a test mode (i.e., the pressure P is applied from above as shown in FIG. 4), the net force F should point in the opposite direction.

Figure 5:
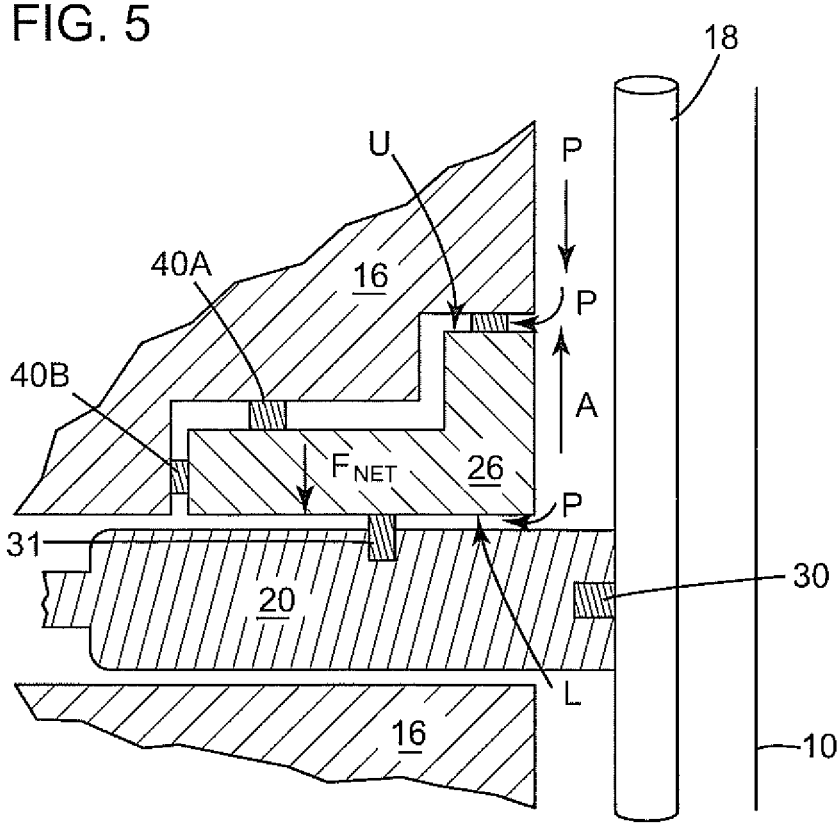
FIG. 5 is a detailed view of the seals provided for the top seat and the ram blocks according to an exemplary embodiment.

Thus, according to an exemplary embodiment illustrated in FIG. 5, a seal 40A disposed between the top seat 26 and the BOP 16 is displaced relative to the seal 31 such that the upper surface U of the top seal 26, which is exposed to pressure P, is larger than the lower surface L of the top seal 26, which is exposed to the same pressure P. In this way, having the same pressure P on both the upper and lower surfaces U and L of the top seat 26, the net force F acts downwards, i.e., towards the ram block 20, thus achieving the seal between the top seat 26 and the ram block 20 when the ram block 20 is closed.

Figure 6:
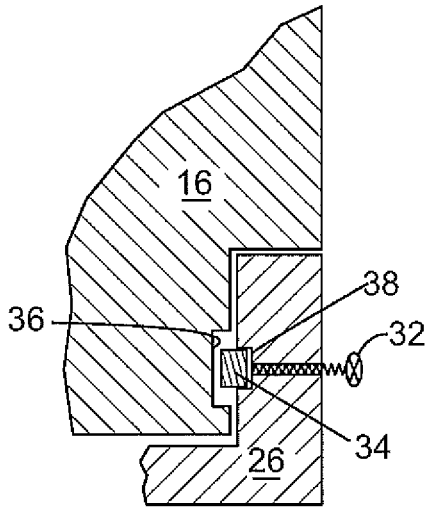
FIG. 6 is a detailed view of a connection between the top seat and a body of the BOP according to an exemplary embodiment.
Figure 7:
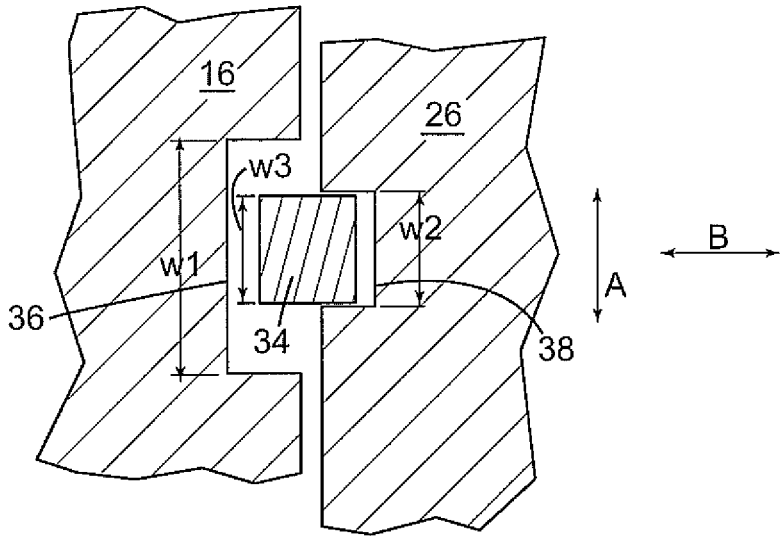
FIG. 7 is a detailed view of a groove of the BOP that accommodates a lock ring according to an exemplary embodiment.

FIG. 6 illustrates, according to an exemplary embodiment, a possible connection between the top seat 26 and the body of the BOP 16 that allows the top seat 26 to be movable. Those skilled in the art would recognize that other connections may be used to hold the top seat 26 at its position while being movable. FIG. 6 shows the lock ring 34 being disposed in grooves 36 and 38. As discussed above, the distances between the various components are increased and not at scale for an easier understanding. However, according to an exemplary embodiment, FIG. 6 shows that for a uniform width lock ring 34, the groove 36 formed in the body of the BOP 16 is wider than the corresponding groove 38 formed in the body of the top seat 26. In other words, the lock ring 34 fits tighter in groove 38 than in groove 36. In one application, the width of groove 36 is up to 6 mm larger than the width of groove 36. This feature is shown in FIG. 7, in which W1 is larger than W2 with an amount between 1 to 6 mm although the corresponding parts of the lock ring 34 that enter grooves 36 and 38 have substantially the same width W3.

This difference in width between the groove 36 and groove 38 allows the top seat 26 to move vertically, for about 1 to 6 mm according to the application discussed above as the lock ring 34 is permitted to float (move vertically along direction A) inside groove 36. According to an exemplary embodiment, the lock ring 34 is allowed to float inside groove 36 but not inside groove 38. Thus, a relative difference between a width W1 of the groove 36 and a width W3 of the lock ring 34 determines the amount of vertical movement of the top seat 26 relative to the body of the BOP 16. The difference in widths W1 and W3, according to an exemplary embodiment, is larger than the normal tolerances in the industry, which are between one tenth and one thousandth of a centimeter. The difference in widths W1 and W3 may be between 1 to 6 mm.

Figure 8:
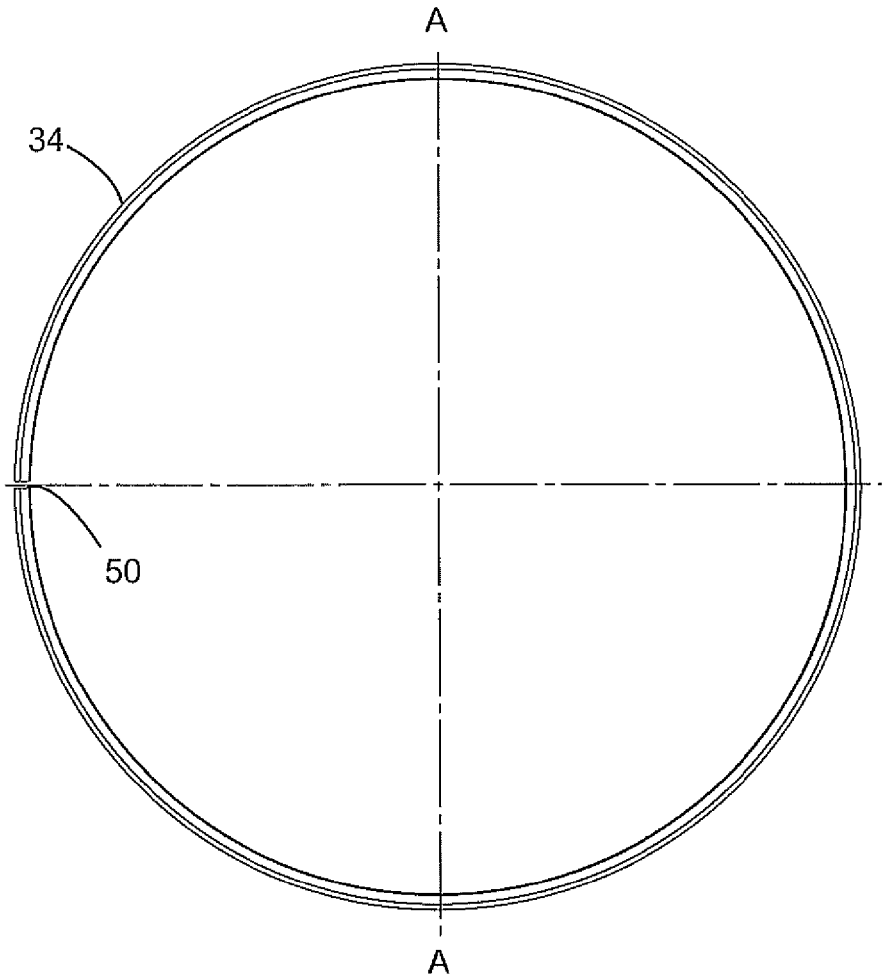
FIG. 8 is an overall view of the lock ring.
Figure 9:
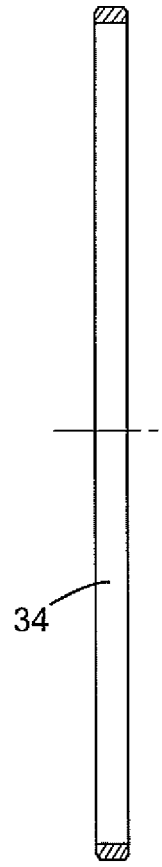
FIG. 9 is a cross sectional view of the lock ring.

For a better understanding of how the top seat 26 is mounted with the lock ring 34 to the body of the BOP 16, the lock ring 34 is shown in more details in FIGS. 8 and 9. FIG. 8 shows an upper view of the lock ring 34. The lock ring 34 has a missing part 50 which is discussed next. FIG. 9 shows a cross section of the lock ring 34, along line A-A of FIG. 8.

Next, it is discussed, according to an exemplary embodiment, how the top seat 26 is assembled with the lock ring 34 to the body of the BOP 16. The lock ring 34 may be placed in the groove 38 of the top seat 26. The top seat 26 together with the lock ring 34 is inserted into position inside the cavity of the BOP 16. The screws 32 are then tighten such that the lock ring 34 increases its diameter, due to the cut 50, and presses against the bottom of the groove 36. In this way, the top seat 26 and the lock ring 34 are fixed to the groove 36 along direction B (shown in FIG. 7) but the top seat 26 and the lock ring 34 are free to move (together as a unit) along direction A.

Figure 10:
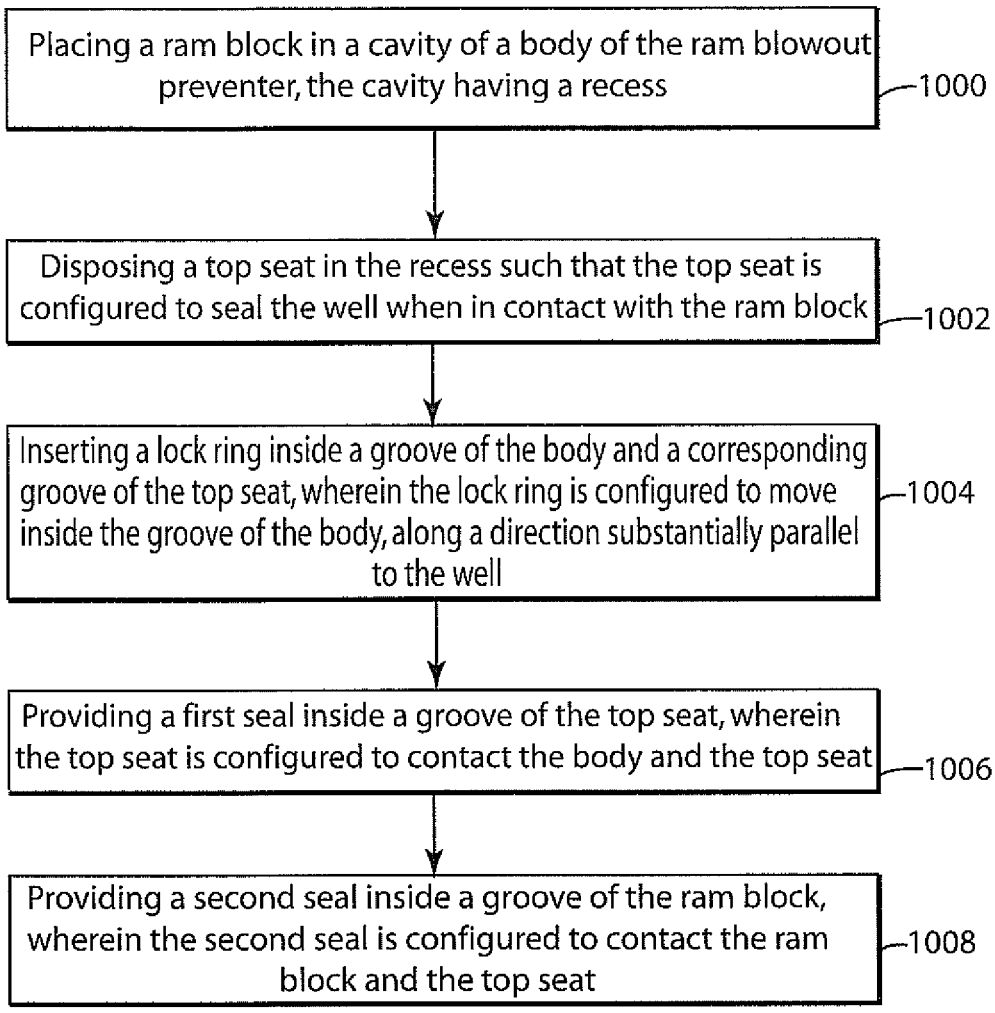
FIG. 10 is a flow chart illustrating steps performed for assembling the BOP according to an exemplary embodiment.

According to an exemplary embodiment, the steps of a method for assembling a ram blowout preventer that is configured to seal a well when a pressure is applied either from above or below of the ram blowout preventer are illustrated in FIG. 10. The method includes a step 1000 of placing a ram block in a cavity of a body of the ram blowout preventer, the cavity having a recess, a step 1002 of disposing a top seat in the recess such that the top seat is configured to seal the well when in contact with the ram block, a step 1004 of inserting a lock ring inside a groove of the body and a corresponding groove of the top seat, wherein the lock ring is configured to move inside the groove of the body, along a direction substantially parallel to the well, a step 1006 of providing a first seal inside a groove of the top seat, wherein the top seat is configured to contact the body and the top seat, and a step 1008 of providing a second seal inside a groove of the ram block, wherein the second seal is configured to contact the ram block and the top seat, wherein a width of the groove of the body is larger than a width of the lock ring by a predetermined value, which is larger than normal tolerances, and a distance from a centerline of the well to the first seal is larger than a distance from the centerline of the well to the second seal.

Figure 11:
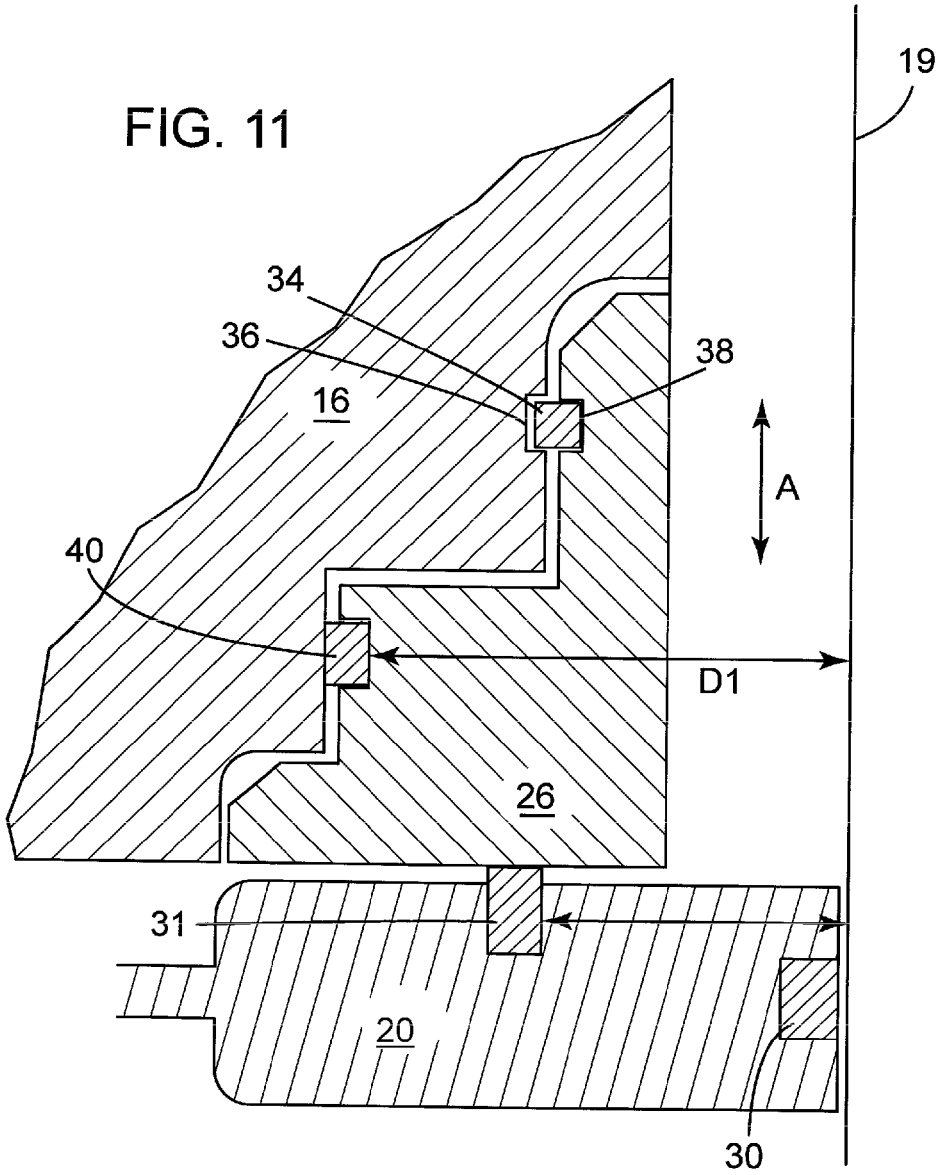
FIG. 11 is a detailed view of the lock ring, top seat, and the ram block of the BOP according to an exemplary embodiment.

FIG. 11 shows together (i) the relative positions of the seals 31 and 40, with an upper surface of the top seat 26 larger than a lower surface, and (ii) the lock ring 34 extending into grooves 36 and 38, with a width of the lock ring 34 smaller than a width of the groove 36 such that the top seat 26 may move along direction A. FIG. 11 also shows that a distance D1 of the seal 40 to a centerline 19 of the well 10 or pipe 18 is larger than a distance D2 of the seal 31 to the centerline 19.

Figure 12:
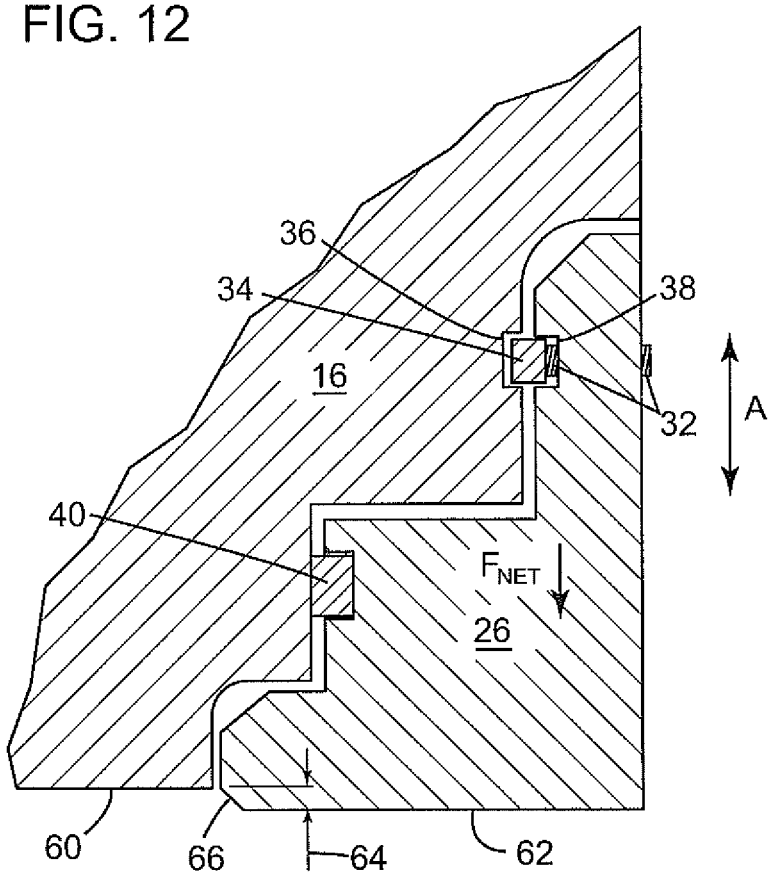
FIG. 12 is a view of a position of a lower surface of the top seat relative to a lower surface of a body of the BOP according to an exemplary embodiment.

According to an exemplary embodiment illustrated in FIG. 12, a lower surface 60 of the body of the BOP 16 is not at the same level as a lower surface 62 of the top seat 26. The position difference along A for the two surfaces 60 and 62 is indicated as 64. This distance 64 may be, in one application, between 1 and 6 mm. The position of the top seat 26, when the ram block 20 is open, i.e., not in contact with the top seat 26, may be such that distance 64 is maximum. When the top seat 26 contacts the ram block 20, when the ram block 20 is moving from the open position to the close position, the top seat 26 moves upwards to accommodate the ram block 20. The top seat 26 may have a slanted region 66 for not affecting the closing of the ram block 20. After the ram block 20 is closed and a pressure is applied from above, as discussed above, a net force F acts downwards on the top seat 26, forcing the top seat 26 towards the ram block 20. This downward motion of the top seat 26 is allowed by the extended width of the groove 36.

Figure 13:
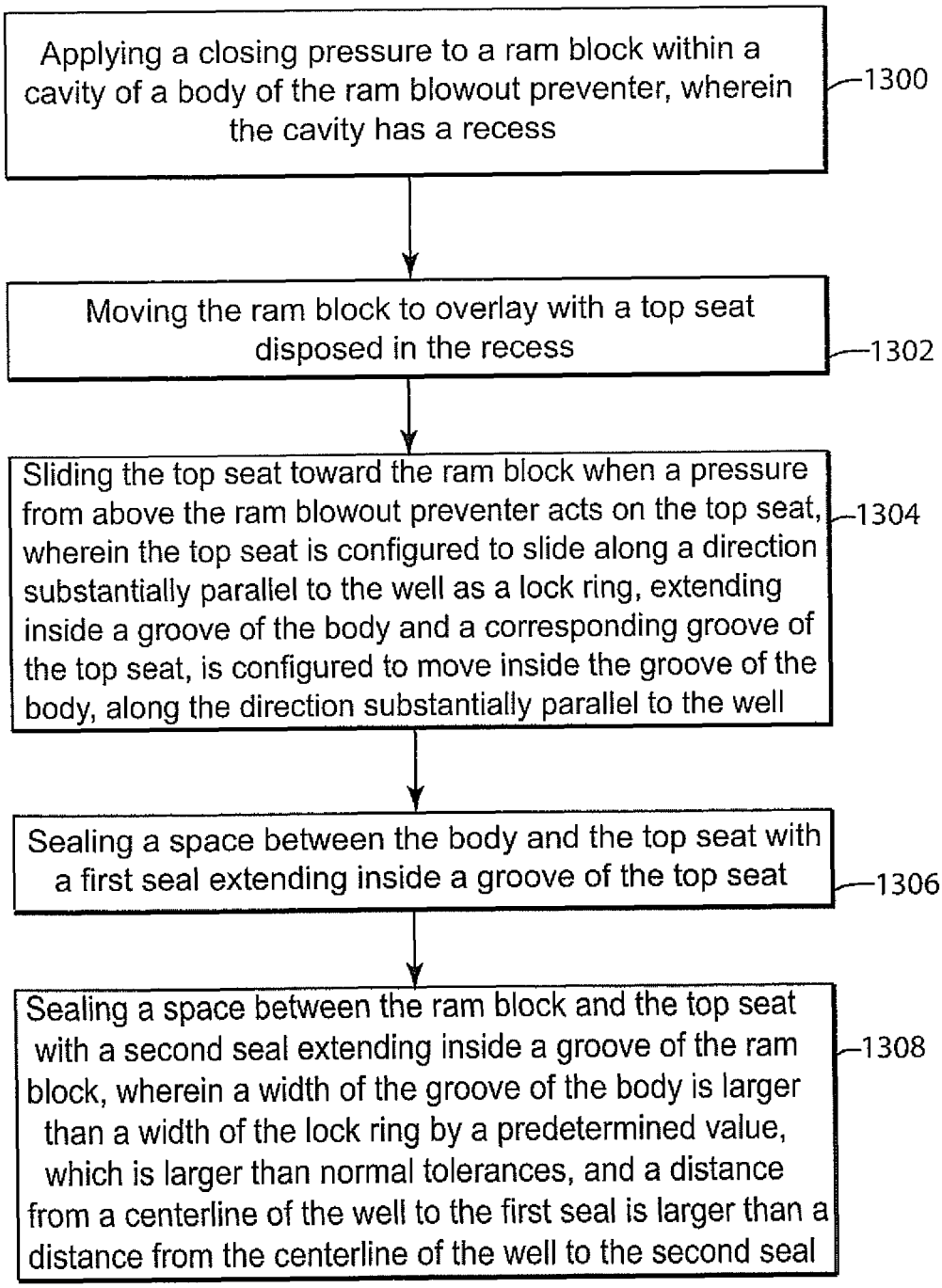
FIG. 13 is a flow chart illustrating steps of a method for sealing a well according to an exemplary embodiment.

According to an exemplary embodiment, the steps of a method for sealing a well with a ram blowout preventer that is configured to seal the well when a pressure is applied either from above or below of the ram blowout preventer are shown in FIG. 13. The method includes a step 1300 of applying a closing pressure to a ram block within a cavity of a body of the ram blowout preventer, wherein the cavity has a recess, a step 1302 of moving the ram block to overlay with a top seat disposed in the recess, a step 1304 of sliding the top seat toward the ram block when a pressure from above the ram blowout preventer acts on the top seat, wherein the top seat is configured to slide along a direction substantially parallel to the well as a lock ring, extending inside a groove of the body and a corresponding groove of the top seat, is configured to move inside the groove of the body, along the direction substantially parallel to the well, a step 1306 of sealing a space between the body and the top seat with a first seal extending inside a groove of the top seat, and a step 1308 of sealing a space between the ram block and the top seat with a second seal extending inside a groove of the ram block, wherein a width of the groove of the body is larger than a width of the lock ring by a predetermined value, which is larger than normal tolerances, and a distance from a centerline of the well to the first seal is larger than a distance from the centerline of the well to the second seal.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A ram blowout preventer for bidirectionally sealing a well, the ram blowout preventer comprising:

a body having a cavity with a recess;

a ram block configured to move between a closed position and an open position inside the cavity;

a top seat disposed in the recess and configured to seal the well when in contact with the ram block;

a movable lock ring extending inside a groove of the body and a corresponding groove of the top seat, a width of the groove of the body being different than a width of the groove of the top seat by at least a predetermined value, the movable lock ring being configured to move inside one of the grooves, along a direction substantially parallel to the well between a first seat position and a second seat position;

a first seal positioned between the top seat and the body, the first seal being configured to contact the body and the top seat; and a second seal positioned between the ram block and the top seat, the second seal being configured to contact the ram block and the top seat when the ram block is in the closed position, wherein a distance from a centerline of the well to the first seal is larger than a distance from the centerline of the well to a point where the second seal contacts each of the ram block and the top seat when the ram block is in the closed position.

2. The ram blowout preventer of claim 1, wherein the predetermined value is between 1 and 6 mm.

3. The ram blowout preventer of claim 1, wherein an upper surface of the top seat, between the first seal and a face of the top seat facing the well is larger than a lower surface of the top seat, opposite to the upper surface, and extending between the second seal and the face facing the well such that when a pressure is applied from above the top seat, a net three generated by the applied pressure on the top seat is pressing the top seat against the ram block when the ram block is closed.

4. The ram blowout preventer of claim 1, wherein the top seat moves integrally with the lock ring.

5. The ram blowout preventer of claim 1, wherein the width of the groove of the body is larger than a width of the corresponding groove of the top seat by the predetermined value.

6. The ram blowout preventer of claim 1, wherein the predetermined value is larger than normal tolerances and normal tolerances are in a range between one tenth and one thousandth of a centimeter.

7. The ram blowout preventer of claim 1, wherein the top seat and the ram block seal the well when pressure is applied either from above or from below the ram blowout preventer.

8. The ram blowout preventer of claim 1, wherein a lower surface of the top seat, in the first seat position, is below an upper surface of the ram block when the ram block is in an open position, and the lower surface of the seat, in the second seat position, is above the upper surface of the ram block when the ram block is in a closed position, at least a portion of the seat not being directly over the ram block when the ram block is in the open position.

9. A method for assembling a ram blowout preventer that is configured to bidirectionally seal a well when a pressure is applied either from above or below the ram blowout preventer, the method comprising:

placing a ram block in a cavity of a body of the ram blowout preventer, the cavity having a recess;

disposing a top seat in the recess such that the top seat is configured to seal the when in contact with the ram block;

inserting a lock ring inside a groove of the body and a corresponding groove of the top seat, a width of the groove of the body being different than a width of the groove of the top seat by at least a predetermined value, the lock ring being configured to move inside one of the grooves, along a direction substantially parallel to the well;

providing a first seal between the top seat and the body, wherein the first seal is configured to contact the body and the top seat; and providing a second seal between the ram block and the top seat, wherein the second seal is configured to contact the ram block and the top seat, wherein a distance from a centerline of the well to the first seal is larger than a distance from the centerline of the well to a point where the second seal contacts each of the ram block and the top seat when the ram block is in a closed position.

10. The method of claim 9, wherein the predetermined value is between 1 and 6 mm.

11. The method of claim 9, wherein an upper surface of the top seat, between the first seal and a face of the top seat facing the well is larger than a lower surface of the top seat, opposite to the upper surface, and extending between the second seal and the face facing the well such that when a pressure is applied from above the top seat, a net force generated by the applied pressure on the top seat is pressing the top seat against the ram block when the ram block is closed.

12. The method of claim 9, further comprising sliding the top seat integrally with the lock ring.

13. The method of claim 9, further comprising:

sealing the well with the top seat and the ram block when the pressure is applied either. from above or from below the ram blowout preventer.

14. A method for bidirectionally sealing a well with a ram blowout preventer that is configured to seal the well when a pressure is applied either from above or below the ram blowout preventer, the method comprising:

applying a closing pressure to a ram block within a cavity of a body of the ram blowout preventer, the cavity having a recess;

moving the ran block to overlay with a top seat disposed the recess;

sliding the top seat toward the ram block when a pressure from above the ram blowout preventer acts on the top seat, wherein the top seat is configured to slide along a direction substantially parallel to the well as a lock ring, extending inside a groove of the body and a corresponding groove of the top seat, is configured to move inside one of the grooves along the direction substantially parallel to the well;

sealing a space between the body and the top seat with a first seal, the first seal being positioned between the body and the top seat; and sealing a space between the ram block and the top seat with a second seal, the second seal being positioned between the ram block and the top seat, wherein a width of the groove of the body is larger than a width of the lock ring by a predetermined value, and a distance from a centerline of the well to the first seal is larger than a distance from the centerline of the well to a point where the second seal contacts each of the seat and the ram block when the ram block is in a closed position.

15. The method claim 14, wherein the predetermined value is between 1 and 6 mm.

16. The method of claim 14, wherein an upper surface of the top seat, between the first seal and a face of the top seat facing the well is larger than a lower surface of the top seat, opposite to the upper surface, and extending between the second seal and the face facing the well such that when a pressure is applied from above the top seat, a net force generated by the applied pressure on the top seat is pressing the top seat against the ram block when the ram block is closed.

17. The method of claim 14, wherein the top seat moves integrally with the lock ring.

18. The method of claim 14, wherein the width of the groove of the body is larger than a width of the corresponding groove of the top seat.

19. The method of claim 14, further comprising:

sealing the well with the top seat and the ram block when a pressure is applied either from above or from below the ram blowout preventer.

* * * * *